US007587884B2

(12) United States Patent
Durand et al.

(10) Patent No.: US 7,587,884 B2
(45) Date of Patent: Sep. 15, 2009

(54) METHOD AND MACHINE FOR ADJUSTING THE HEIGHT OF CRATES WITH SQUARE OR RECTANGULAR CROSS SECTION, FOR EXAMPLE FOR SHIPPING GOODS

(75) Inventors: Claude Durand, Gemenos (FR); Frédéric Duffes, Aix en Provence (FR)

(73) Assignee: B Plus Development, Societe Anonyme, Gemenos (FR)

( * ) Notice: Subject to any disclaimer, the term of this patent is extended or adjusted under 35 U.S.C. 154(b) by 255 days.

(21) Appl. No.: 11/719,850

(22) PCT Filed: Nov. 18, 2005

(86) PCT No.: PCT/FR2005/002864

§ 371 (c)(1),
(2), (4) Date: Jul. 5, 2007

(87) PCT Pub. No.: WO2006/053989

PCT Pub. Date: May 26, 2006

(65) Prior Publication Data

US 2009/0149306 A1 Jun. 11, 2009

(30) Foreign Application Priority Data

Nov. 22, 2004 (FR) ..... 04 12375

(51) Int. Cl.
*B65B 7/00* (2006.01)

(52) U.S. Cl. ..... 53/504; 53/503; 53/76; 53/445; 53/456; 53/476; 53/52; 53/458; 53/486; 53/495; 53/376.4

(58) Field of Classification Search ..... 53/503, 53/504, 76, 445, 456, 476, 52, 458, 486, 53/495, 376.4
See application file for complete search history.

(56) References Cited

U.S. PATENT DOCUMENTS

| | | | | |
|---|---|---|---|---|
| 3,468,097 | A | 9/1969 | Mack | |
| 4,300,716 | A * | 11/1981 | Jennings | 229/160 |
| 5,501,065 | A * | 3/1996 | Fischer et al. | 53/535 |
| 6,473,718 | B1 * | 10/2002 | Bierschenk et al. | 702/155 |

* cited by examiner

*Primary Examiner*—Christopher Harmon
(74) *Attorney, Agent, or Firm*—Egbert Law Offices PLLC

(57) ABSTRACT

The invention concerns a method for adjusting height of a crate or box made of flexible material, having a base and at least four side walls by folding. After the base has been placed in a generally horizontal, a horizontal crease is produced on each side wall, parallel to the base and at a height substantially equal to a top of a stack of objects. At least one oblique crease is produced in each corner of the crate, with one end located at the intersection between two horizontal creases and the other end located on an upper ridge of one side wall. The upper part of each side wall is folded towards the center of the crate, at an angle substantially equal to 90°. The various flaps are folded on one another, being separated by oblique creases, bringing the upper part of side walls in a substantially horizontal plane.

16 Claims, 11 Drawing Sheets

METHOD AND MACHINE FOR ADJUSTING THE HEIGHT OF CRATES WITH SQUARE OR RECTANGULAR CROSS SECTION, FOR EXAMPLE FOR SHIPPING GOODS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

This invention concerns a method and a machine for adjusting the height of cardboard boxes(or crates), corrugated fiberboard or similar sheet material, with a square or rectangular cross section, for example, for shipping various goods and merchandise.

The technical domain of the invention is that of machines for processing, cutting, manufacturing or sealing of packaging materials or that of the manufacture or application of adjusting materials for such packing.

This invention is more particularly related to the height adjustment of boxes or crates used for preparing orders of a single item or multiple items, and more generally of boxes or crates in which the contents have variable volumes from one box to another. Boxes of this type are known to be made by machines using sheet blanks featuring different flaps that are glued together or held together by an adhesive bond.

2. Description of Related Art Including Information Disclosed Under 37 CFR 1.97 and 37 CFR 1.98

Boxes are known that, after they are formed, consist of five sides, with a square or rectangular bottom and a girdling composed of four side walls. The well-known boxes of this type are called "American half-boxes", "boats" or "bell boxes". These boxes are, after they are filled, closed by a lid. One is familiar with lids that have four flaps that are turned down and glued together on the sides of the crate. Lids are also known in which the various flaps have previously been formed by proper fitting or gluing. These covers are inserted on the top of the case and united with the case by gluing, stitching or by a metal or plastic strap.

Boxes or crates are known that, after forming, consist of five walls, like the boxes previously described, and four top flaps. Each of these flaps is connected to one of the side walls of the case by a scored line. The known boxes of this type are called "American boxes".

Once filled, these boxes are closed by folding over the four top flaps that are secured in position by glue, stitches or by a metal or plastic strap. The described boxes have the characteristic of providing a constant volume after manufacture and closure.

Several methods are applied by users or are integrated into the case-forming or case-sealing machines, for immobilizing the various objects, the unit volume of which will vary from one case to another.

Thermo-shrinkable plastic layers are known in which one or several sheets are sealed to the bottom or the side walls of the case while it is being formed. After the case is filled, these layers are folded over on the stack of objects, then shrunk by passing them through a heating tunnel. One is also familiar with polystyrene particles that are spread inside the case after it is filled to take up any unused space.

Also known are the inflatable plastic pockets that are arranged inside the boxes to fill up this unused space.

One is also familiar with the shredded cardboard or paper sheets of various shapes, placed inside the boxes to fill up any unused space.

Fastening sheets provided with flaps are also known, and these sheets are introduced in the case to contact the stack of objects. Then, the flaps are attached to the internal faces of the side walls of the case to ensure that objects are held secure.

These manufacturing methods have numerous drawbacks.

The securing methods are often burdensome.

The fastening devices, except when they are made from the same material as the packing itself, must be necessarily separated from the cardboard packing prior to any waste collection and potential recycling. On the other hand, the materials used are more often than not difficult to recycle. Such waste collection and recycling involve complex and very burdensome operations. Performing these operations is difficult and requires complex automated machines or a large number of man-hours. The cost of these operations is therefore high.

The shipped volume, which is the same as the volume of the manufactured case, is quite often much greater than the usable volume, which corresponds to the volume of the objects placed inside the case. The result is an increase in transportation costs of the boxes.

A method is also known to involve removal of the top section of the boxes, located above the stack of objects so as to reduce the height of the box to the usable height and to secure the objects by placing the top cover as close as possible to the top of the stack of objects.

This method also has some drawbacks.

Breaking down the box is a delicate task that entails the use of dangerous cutting tools.

The automatic removal of the top cut portion of the box is a difficult task that also generates a significant volume of waste that must be collected and disposed of.

Automating this process requires the making of complex machinery. The challenge therefore consists of providing a means to secure the objects inside the boxes used for packing and shipping packages with variable usable volume, and reducing the volume of these boxes as much as possible to this usable volume, without resorting to any fastening material and without removing a portion of material of this box, and without making any cuts to this box at all.

BRIEF SUMMARY OF THE INVENTION

The solution to this problem consists of providing a method for adjusting the height of a box made of a pliable material, consisting of a base and at least four side walls, by folding the high portions of said side walls of said box on top of the stack of objects placed in said box.

The method used for adjusting the height of said boxes is noteworthy.

After having placed the bottom of the box in an essentially horizontal position, on each of said side walls, a horizontal score (scoring) is made at a height essentially the same as that of the top of said stack of objects.

On each of the angles of the box, an oblique score (scoring) is made where one end is located at the intersection between both said horizontal scores. The other end is at the upper ridge of one of the side walls, so that said oblique score will form an angle of about 45° (degrees) with the horizontal plane at the bottom of said box.

The top portion of each of said side walls is folded toward the center of the box, around said horizontal score, with an angle of about 90°, and simultaneously the various flaps are folded over one another, separated by said oblique scores, which make up the high portions of these side walls, around said oblique scores with an angle of about 180°, so as to place said high portions of said side walls on a substantially horizontal plane.

In an advantageous application of the process of the invention, each of said horizontal scores is obtained by placing a mandrel inside of said box, with said mandrel having a horizontal sharp-edged ridge positioned against the internal face of the side wall at the score line to be made. The action of a roller (traveling wheel), which is applied and pressed against the external face of this side wall and moved along this ridge, flattens said side wall against said ridge.

Advantageously, each of said creases or scoring marks is obtained by placing a mandrel inside said box. The mandrel has an anvil, which is positioned against the internal face of the side wall at the score line to be made. By the action of a tool that has a steel ridge, which is applied and pressed against the external face of said side wall, the tool makes said oblique score, crushing said side wall against said anvil.

In an advantageous application, said chuck is stationary and the height of said rollers and said tools is fixed. The vertical positioning of said box is in relation to said mandrel, rollers and tools, so that said horizontal creases or horizontal scorings, made at a height essentially the same as that of the top of said stack of objects, are achieved by the placement of said box around said mandrel, generated by the upward vertical movement of an elevator supporting said box.

Advantageously, after making said horizontal scores and said oblique scores, a horizontal stress is exerted initially on the high portions of said side walls that have oblique scores, in order to ensure their partial folding toward the center of the box. The folding brings about, simultaneously, the partial folding of the high portions of side walls not provided with oblique scores, which are adjacent. Then, a vertical stress directed toward the bottom on the high portions of said side walls is exerted, until their complete folding so as to place them horizontally, at about the top of the stack of objects.

The result of these operations, is that on the one hand, the height of the box has been reduced to the usable height corresponding to the height of the stack of objects previously placed inside the box. Also, the volume of the crate has been reduced to a space close to the usable volume corresponding to the volume of the objects previously placed inside said box.

On the other hand, a secure fitting of the objects placed in the box can be easily achieved by placing a cover as close as possible to the top of the stack of objects and by the presence of the different flaps between the objects and the cover, folded over from the high portions of the side walls of said box.

Thus, by the process of the invention, the objects placed inside the box are perfectly secured inside and the volume of the box is reduced, which lowers the shipping costs of said box, without using any fastening material other than the box itself, and without removing any portion of the material of this box, or performing any cutting operations on the box. The implementation of the process of the invention does not generate any fiberboard trim, so that no waste retrieval, storage and disposal operations are necessary during the process of filling, height adjusting and sealing of the box. Additionally, this invention concerns a machine for adjusting the height of the box consisting of a base and at least four side walls, folding the high portions of said side walls of the box on top of the stack of objects previously placed in said box.

The machine is noteworthy in that it comprises:

means for making a horizontal crease or scoring on each of said side walls at a height about the same as that of the top of said stack of objects;

means of making, at each of the angles of said box, at least one oblique crease or scoring in which one end is at the intersection between two of said horizontal creases and the other end is at the upper ridge of one of the side walls, so that said crease is at an angle of about 45° with the horizontal plane; and means of folding the high portion of said side walls toward the center of the box, around said horizontal crease and folding, simultaneously, the different flaps, one on top of the other, the different flaps comprising the high portions of these side walls, around said oblique creases, so as to place said high portions of said side walls on a substantially horizontal plane.

In an advantageous way of carrying out the invention, said machine consists of a fixed mandrel and an elevator located below said mandrel and designed to place said box around the latter.

Advantageously, for each of said horizontal creases to be made, the machine contains a horizontal sharp-edged ridge set on the lower portion of said mandrel, and a roller that moves along said ridge crushing said side wall against said ridge.

Advantageously, said machine also comprises, for each of said oblique creases to be made, a fixed anvil on the side of said mandrel and a tool that has a sharp-edged ridge that can move toward said anvil as it crushes said side wall against said anvil.

According to an advantageous way of carrying out the invention, said elevator consists of a base plate or lower plate and a second plate or upper plate on which the crate rests. The upper plate is mobile in relation to said lower plate, so that, as the elevator moves upward vertically, the box and the upper plate come to a stop when the top of said stack of objects lodged in the box comes into contact with the lower face of said mandrel. The movement of the lower plate can proceed with a predetermined amplitude (independently from the box filling level) because of the relative movement of said upper plate in relation to said lower plate.

Advantageously, said machine also comprises a die and a second elevator located below said die and designed to position, by an upward vertical movement, said box in said die, in order to fold the high portions of the side walls of the box, so as to place them on the horizontal plane, located substantially at the top of the stack of objects.

Advantageously, said die consists of at least one deflector, which exerts, at the beginning of the movement of positioning said box in said die, a stress with a horizontal component on the high portions of the side walls that have oblique creases, ensuring their partial fold toward the center of the box. The die also consists of at least one pressure plate, which exerts, at the end of the movement that inserts said box in said die, a vertical stress on the high portions of the side walls that do not have an oblique crease, ensuring the complete folding of the high portions of all side walls in order to bring them in a horizontal plane located at about the top of the stack of objects.

Advantageously, this second elevator also features a base plate or lower plate and a secondary plate or upper plate on which the box rests, before folding its top parts. This upper plate is mobile in relation to said lower plate, so that, when the elevator moves upward vertically, the box and the upper plate stop when the fold-back of all side walls is completely achieved. The movement of the lower plate can proceed with a predetermined amplitude (independent of the box filling level), because of the relative movement of said upper plate in relation to said lower plate.

In an advantageous way of carrying out the invention, said machine also comprises means for depositing, on the external face of certain flaps that make up the high portions of the side walls that have oblique creases, glue points or beads which allow for bonding said flaps to one another after folding of said flaps, one on top of another. The high portions of all the box side walls are held in a substantially horizontal plane after they are completely folded back, in spite of the elasticity of the pliable material used to make the box.

BRIEF DESCRIPTION OF THE SEVERAL VIEWS OF THE DRAWINGS

The advantages obtained by the invention will be better understood through the following description that relates to the attached drawings, which illustrate, without any limiting characteristic, a particular way of carrying out the process and building a machine according to the invention.

DETAILED DESCRIPTION OF THE INVENTION

In the presentation below, words, such as "horizontal" "vertical", "upper", "lower", are used considering the position and optimal movements of boxes during different phases of the process for adjusting the height of these boxes. Nevertheless, it is stressed that these words are not of a limiting nature, since these movements may be made in directions close to horizontal or vertical or both.

Figure 1:
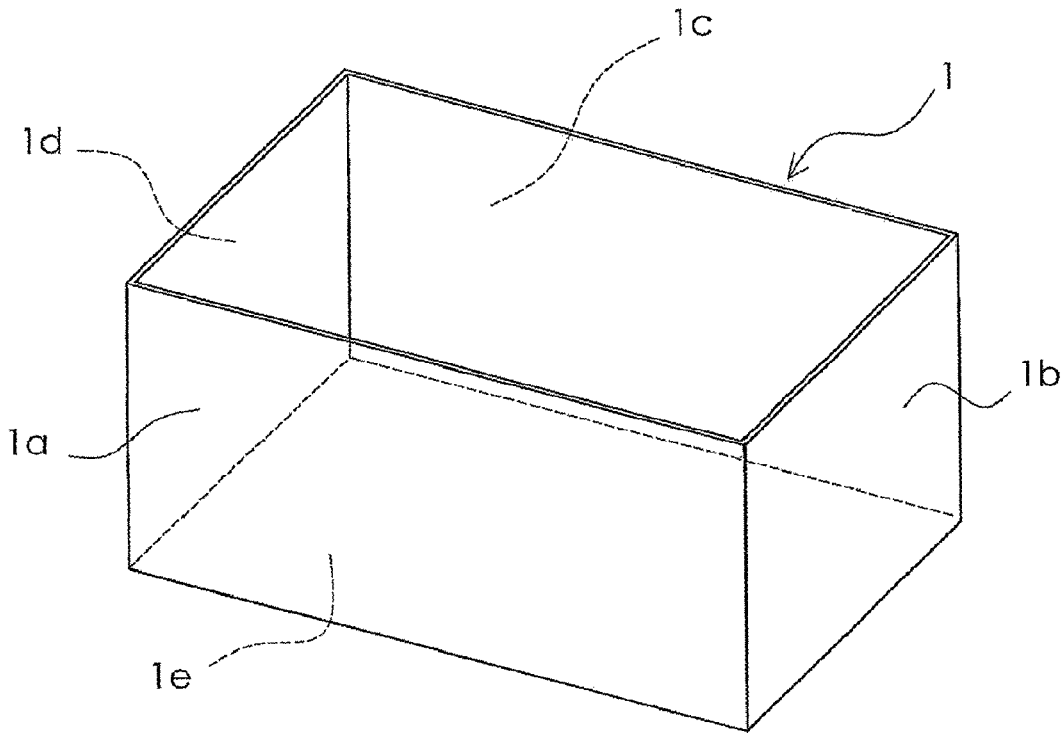
FIG. 1 is an isometric perspective view of an empty box usable for implementing the method and machine according to the invention.

FIG. 1 shows box 1 used by the machine according to the invention. Said box 1 consists of a base 1*e* and of at least 4 side walls, 1*a*, 1*b*, 1*c* and 1*d*. According to the illustrated example, the base is rectangular in shape, so that the box has the shape of a rectangular parallelepiped. It is to be noted that the base could have a square shape or substantially square shape, for example, a generally square or rectangular shape with cut angles.

As indicated, this box 1 can be made of corrugated fiberboard, solid fiberboard or any other equivalent material made of pliable sheets.

Figure 2:
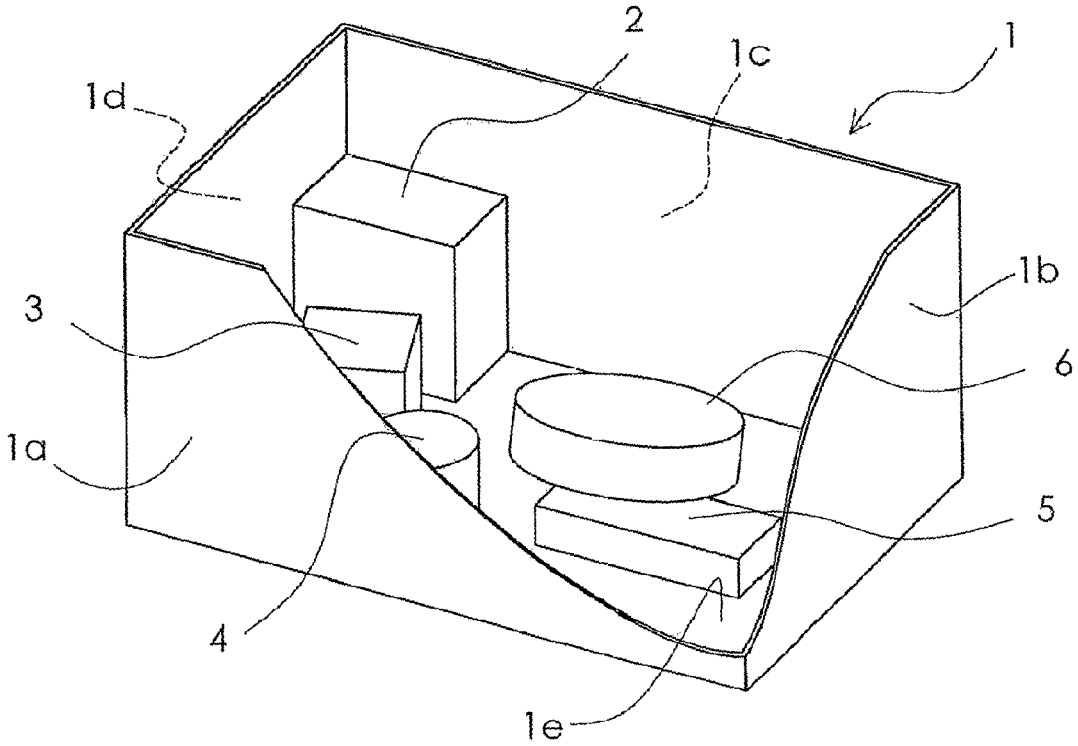
FIG. 2 is an isometric cross-sectional view of a box of the same type, filled with a certain number of objects of various shapes and dimensions.

FIG. 2 shows box 1, consisting of base 1*e* and side walls 1*a*, 1*b*, 1*c* and 1*d*, in which a certain number of objects 2, 3, 4, 5 and 6 of varied shapes and dimensions have been placed. The objects can be of any number and size, and their placement in the box can also vary. The objects can be, in particular, stacked one on top of the other, if necessary. To justify and authorize the box treatment by the machine according to the invention, the height of the stack of objects must be substantially lower than the height of the box. If the height of the stack of objects is likely to be, for certain boxes, substantially the same as or greater than the box height, these boxes, said to be "full", will not be placed in the machine or a special operating mode of the machine will be provided so that the boxes can go through the machine without the main stages of the operating cycle of the machine taking place.

Figure 3:
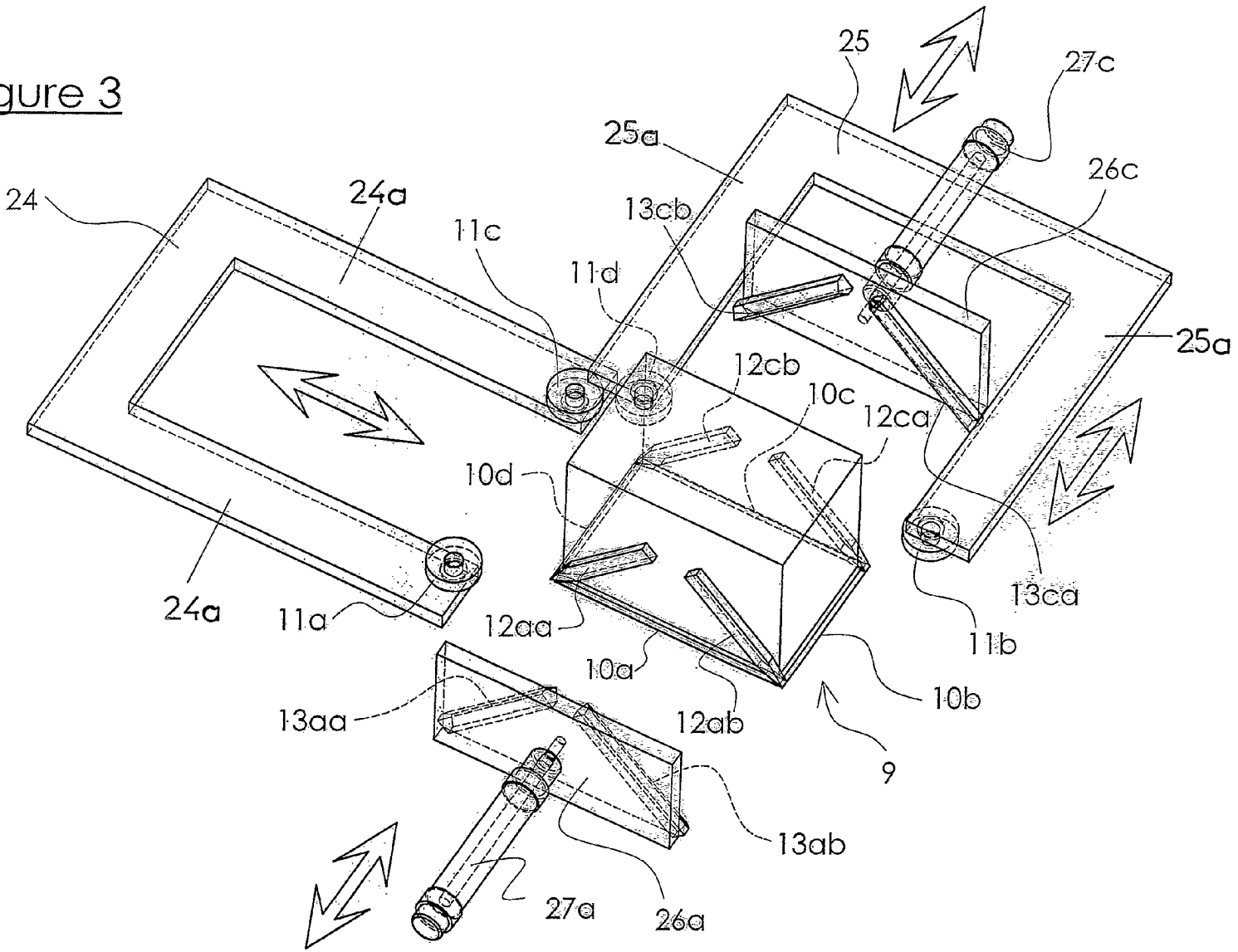
FIG. 3 is an isometric perspective view of a part of the machine according to the invention.

FIG. 3 shows the part of the machine used to make both the horizontal and the oblique creases. This figure shows mandrel 9, equipped with horizontal ridges 10*a*, 10*b*, 10*c* and 10*d* and anvils 12*aa*, 12*ab*, 12*ca* and 12*cb*. The horizontal ridges are sharp-edged. The surface of the anvils is substantially flat. The relative position of these ridges and anvils on the chuck corresponds to the relative position of creases to be made on the fiberboard. This FIG. 3, also shows rollers 11*a*, 11*b*, 11*c* and 11*d*, for the purpose of assisting in achieving the horizontal creases on the sides of box 1. Both rollers 11*a* and 11*c*, intended for creating the horizontal creases on the large sides of crate 1*a* and 1*c*, are mounted on a single moving open frame 24. Both rollers 11*b* and 11*d*, designed to make the horizontal creases on small sides 1*b* and 1*d* of the box, are mounted on a second moving open frame 25. Moving frames 24 and 25 are moved orthogonally by known linear actuators (not depicted), and they are generally U-shaped. A pressure roller 11*a*, 11*c* or 11*b*, 11*d* is positioned near the free ends of these moving open frames 24 and 25, respectively. Pressure rollers 11*a*, 11*b*, 11*c* and 11*d* are positioned in the same horizontal plane. Rollers 11*a*, 11*b*, 11*c* are, for example, mounted on the upper face of parallel branches 24*a* of open frame 24, while rollers 11*b*, 11*d* are mounted under the lower face of parallel branches 25*a* of open frame 25, moving at a level slightly higher than that of said open frame 24. To make said horizontal creases, box 1 is positioned around chuck 9 at the desired height, then said frame 24 is moved parallel to the longitudinal axis of the box and said frame 25 is moved parallel to the transverse axis of the box. These movements of frames 24 and 25 must be synchronized so as to avoid any interference between the rollers during the movements of said moving frames.

The crease of each side wall is made by crushing the fiberboard between a roller and a ridge as the roller moves. This crushing is itself achieved by adjusting the roller-to-ridge distance at a smaller dimension than the nominal thickness of the fiberboard sheet used to make said box or by activating devices designed to press the roller flat against the ridge, for example, by using springs.

It should be noted that said devices represent one of the advantageous ways of building the machine. Other ways of execution could be used for which the movements of the rollers would be independent from one another or associated in a different way. It would also be possible to build a machine for which the horizontal creases would be made with the help of anvils and tools with sharp-edged ridges, such as provided for making oblique scores in the way of execution that was retained.

This FIG. 3 also shows tools 13*aa*, 13*ab*, 13*ca* and 13*cb*. All of these tools have a sharp-edged ridge. Both tools 13*aa* and 13*ab*, designed to make the oblique creases on one of the large box side walls 1*a*, are mounted on the same moving plate 26*a*. Both tools 13*ca* and 13*cb*, designed to make the oblique creases on the other large box side wall 1*c*, are mounted on a second moving plate 26*c*. To make said oblique creases, box 1 is positioned around chuck 9 at the desired height, then said plates and said tools are moved toward the anvils facing them. This figure also shows linear actuators 27*a* and 27*c*, used to move said plates 26*a* and 26*c*.

The creases are made by crushing the fiberboard between the ridges of the tools and the anvils and can be adjusted by regulating the pressing force of these tools against the anvils. It should be noted that said arrangements represent one of the advantageous ways of building the machine. Other ways of execution could be used for which the oblique creases would be made on other fiberboard walls or by differently associating the tools and their movements. It would also be possible to build a machine for which the oblique creases would be made with the help of sharp-edged ridges mounted on the mandrel and moving rollers, as provided for making horizontal creases in the way of carrying out the invention that has been retained.

Figure 4:
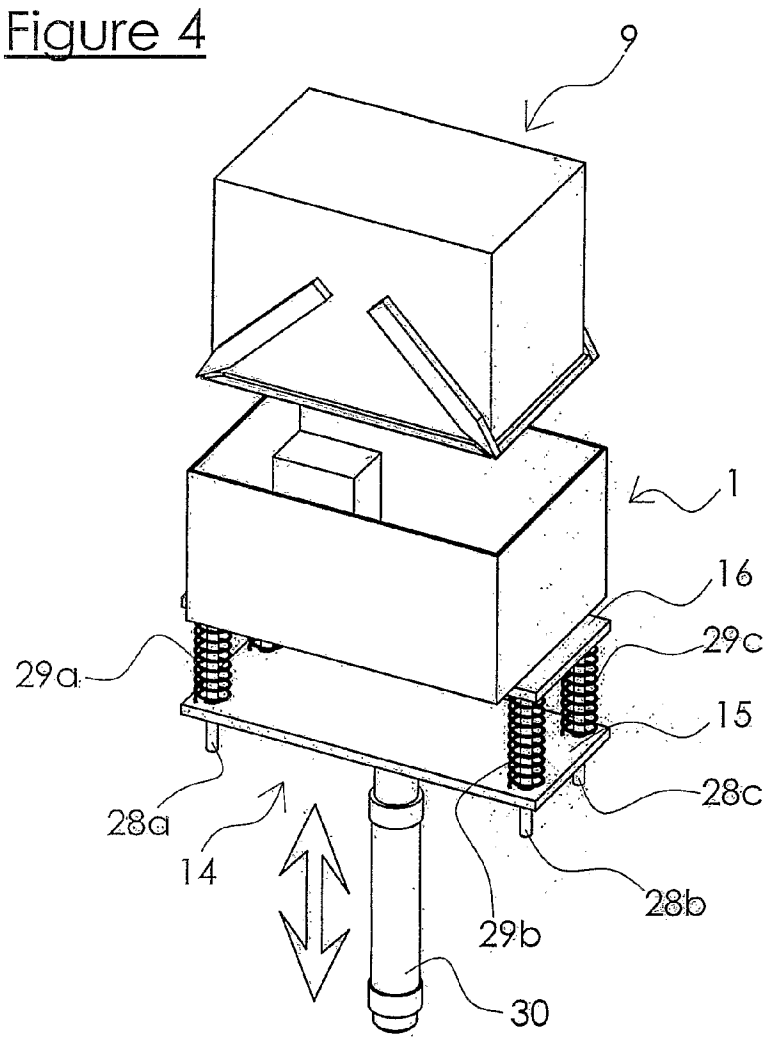
FIG. 4 is also an isometric cross-sectional view of a box and a part of the machine according to the invention.

FIG. 4 shows fixed mandrel 9 and the first elevator 14 in which the vertical movement is used for positioning box 1 in relation to said mandrel so that the horizontal creases will be made at a height substantially equal to that of the top of the stack of objects.

This figure also shows base plate or lower plate 15 mounted on the moving part of elevator 14 and secondary plate or upper plate 16 moving in relation to said base plate.

This figure also shows guide columns 28*a*, 28*b* and 28*c*, which guide the vertical movements of said plate 16 in relation to said plate 15 following an axis of linear movement.

Thus, in the upward vertical movement of said elevator 14, while the top of the stack of objects placed in box 1 comes into contact with the lower face of said mandrel 9, said box 1 and said upper plate 16 stop, and said lower plate 15 continues its movement produced by linear actuator 30. This construction arrangement allows for simple steering of said driver 30 with always the same upper limit stop position, regardless of the level to which said box 1 may be filled.

Finally, return springs 29*a*, 29*b* and 29*c* are placed between plates 15 and 16, which return said upper plate 16 to a reference position in relation to said lower plate 15 when there is a loss of contact between the top of the stack of objects and the lower face of said mandrel 9 during a return descent of said elevator 14.

Figure 5:
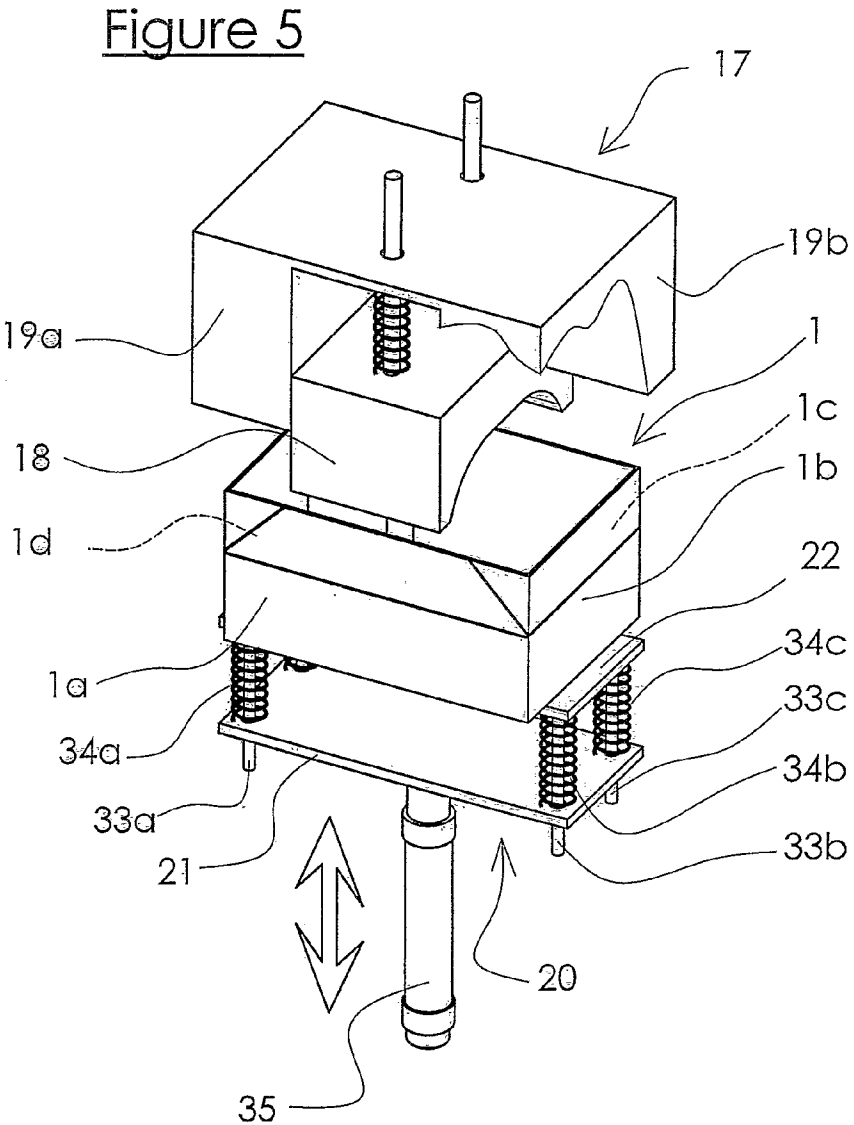
FIG. 5 is also an isometric sectional view of a box and a part of the machine according to the invention.

FIG. 5 shows die 17 and the second elevator 20 used to perform the fold-back of high portions of side walls of said fiberboard box 1.

On this figure, a deflector device 18 operates, in an initial phase, upon the upward movement of said elevator 20, on the upper ridges of side walls 1*a* and 1*c* of box 1, exerting on them a horizontal force that tends to fold the high portions of said side walls toward the center of said crease 1.

It is understood that the folding of the high portions of side walls 1*a* and 1*c*, in this first phase, simultaneously brings about a folding toward the center of said box 1 of the high portions of adjacent side walls 1*b* and 1*d* and with which they are linked at the angles of said box 1.

This figure also shows two press box devices 19*a* and 19*b*. FIG. 5 represents a sectional view of pressure device 19*b*, so as to allow a good view of said deflector 18. The shape of said pressure device 19*b* is identical to that of said pressure device 19*a*, and both of them have a substantially flat lower face. Said pressure devices 19*a* and 19*b* operate, in the second phase, upon the upward movement of said elevator 20, on the upper portions of said side walls 1*b* and 1*d* of box 1, exerting on them a vertical stress that allows to completely fold said upper portions of said side walls toward the center of said box 1 so as to bring them in the horizontal plane located substantially at the top of the stack of objects. In other words, the horizontal plane is a plane parallel or substantially parallel to the plane where bottom 1*e* of the box is located.

It is clear that the folding of the upper portions of side walls 1*b* and 1*d*, in this second phase, simultaneously results in a folding, toward the center of said box 1, the upper portions of adjacent side walls 1*a* and 1*c*. They are linked at the angles of said box 1, so that these are also brought in the horizontal plane located substantially at the top of the stack of objects.

This figure also shows the base plate or lower plate 21 mounted on the moving part of elevator 20 and the secondary plate or upper plate 22 moving in relation to said lower plate. This FIG. 5 also shows the guide columns 33*a*, 33*b* and 33*c*, which guide the vertical movements of said plate 22 in relation to said plate 21 following an axis of linear displacement.

Thus, in the upward vertical movement of said elevator 20, when said deflector 18 and said pressure devices 19*a* and 19*b* have completely folded the upper portions of the box side walls, said box 1 and said upper plate 22 stop and said lower plate 21 continue movement produced by linear actuator 35. This construction arrangement allows a simple steering of said actuator 35 with always the same upper limit stop position, regardless of the level to which said box 1 is filled.

Finally, return springs 34*a*, 34*b* and 34*c* are placed between plates 21 and 22, which bring said upper plate 22 to a reference position in relation to said lower plate 21 when there is a loss of contact between the folded walls of said box 1 and the lower portion of said die 17 during the return descent movement of said elevator 20.

Figure 6:
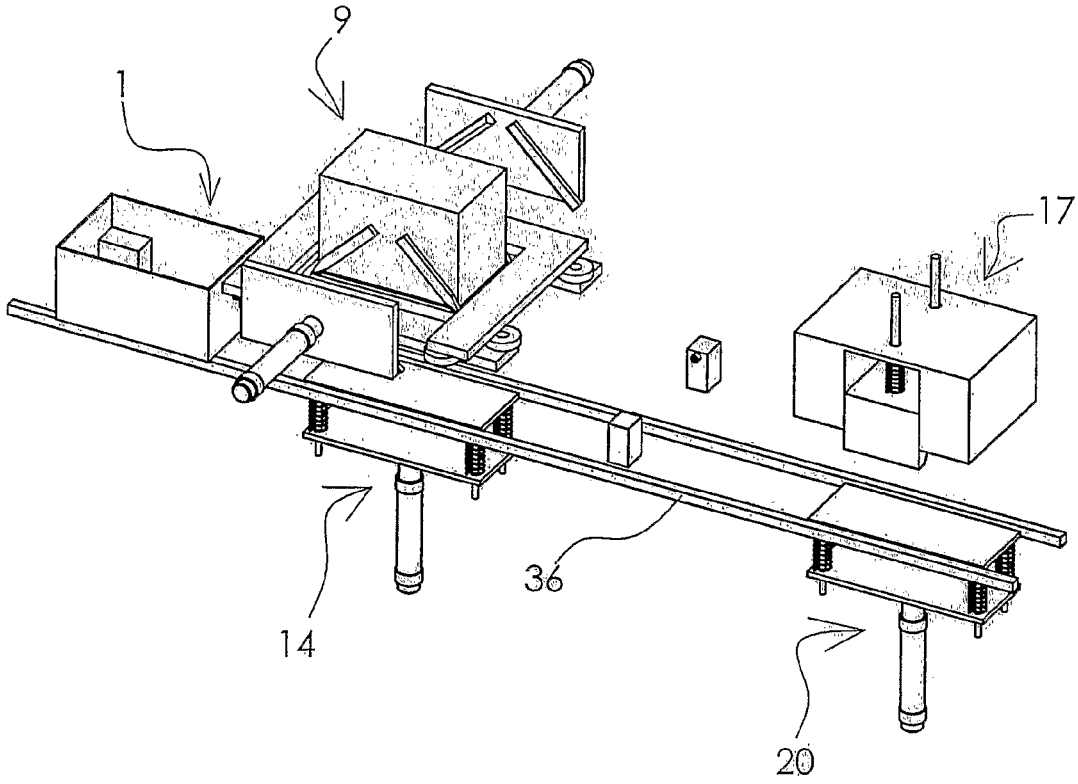
FIGS. 6 through 17 are isometric perspective views of boxes and the machine according to the invention in twelve successive stages of operation.
Figure 7:
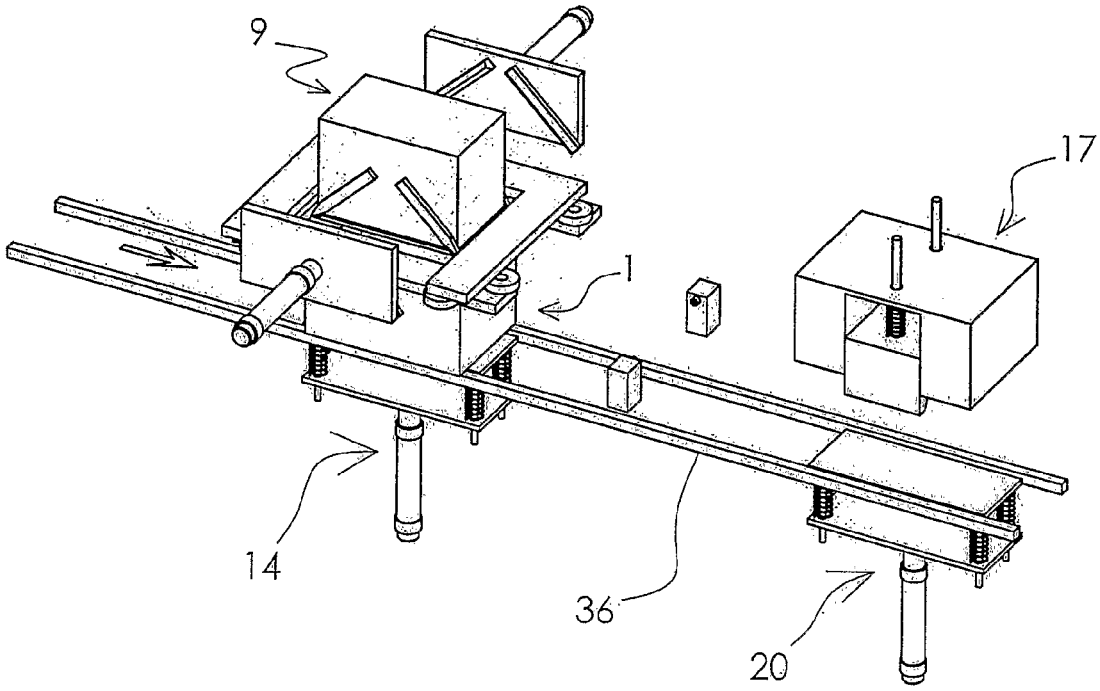

FIGS. 6 through 17 show said box 1 and said machine according to the invention at different stages of the operating cycle, following a chronological order. To simplify the depiction, FIGS. 6 through 7 show only one single box processed by the machine. It is obvious that, in an advantageous execution and operational mode of said machine, several boxes may be processed simultaneously by the machine, each of them at the various work stations, with simultaneous transfer of said boxes from one work station to the next work station.

FIG. 6 shows a conveyor system with horizontal movement 36 to place said box 1 in the machine, then move successively to the various work stations of the machine. Base 1*e* of said box is laid out horizontally or approximately horizontally during its run through the machine. FIG. 6 shows box 1 as it enters the machine. FIG. 7 shows said box 1 at the first work station, under said mandrel 9.

Figure 8:
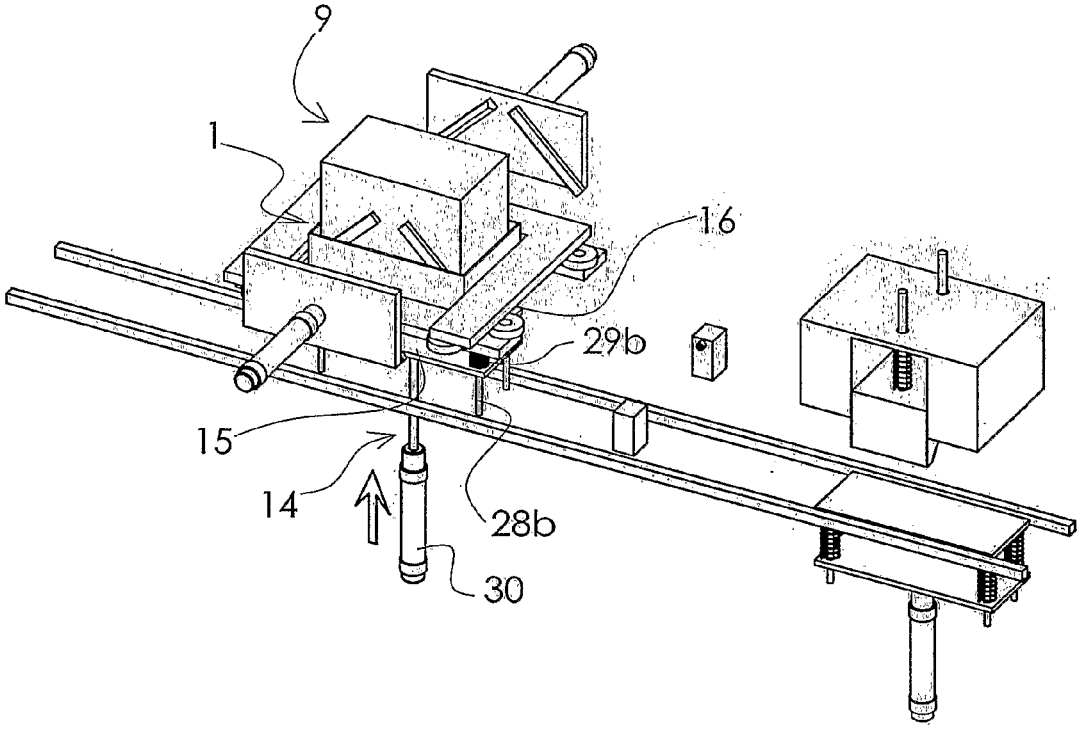
Figure 9:
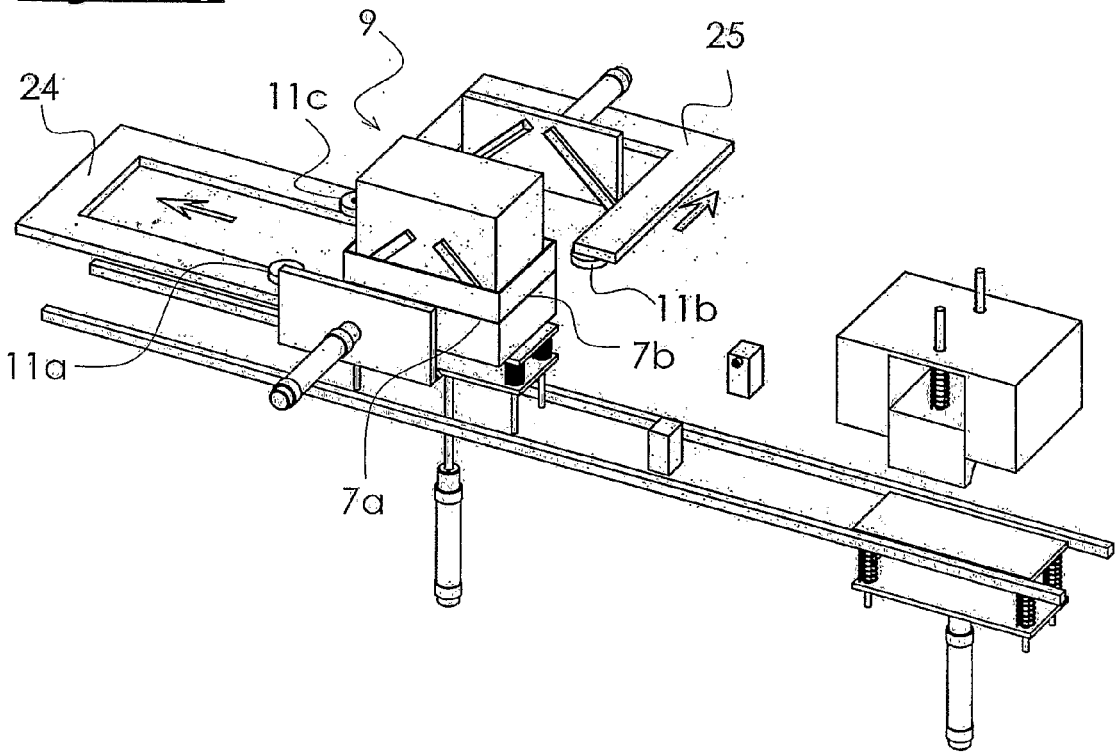

FIG. 8 shows box 1 in the upper position after the rise of elevator 14 produced by actuator 30. It is obvious that the objects placed in box 1 came in contact with the lower face of mandrel 9 and that the vertical movement of said box 1 and upper plate 16 which carries it were stopped while lower plate 15 continued its upward movement. Guide column 28*b* of said plate 16 is in relation to said plate 15, and spring 29*b* is compressed by the relative movement of said plates 15 and 16. FIG. 9 shows that frame 24 and 25, which carry rollers 11*a*, 11*b*, 11*c* and 11*d*, moved horizontally. One understands that these horizontal movements resulted in the horizontal creases 7*a*, 7*b*, 7*c* and 7*d* by crushing the side walls of said box 1 between said rollers and said horizontal ridges 10*a*,

10*b*, 10*c* and 10*d* (not visible on FIG. 9) of said mandrel 9. The horizontal creases 7*a* and 7*b* are shown in FIG. 9.

Figure 10:
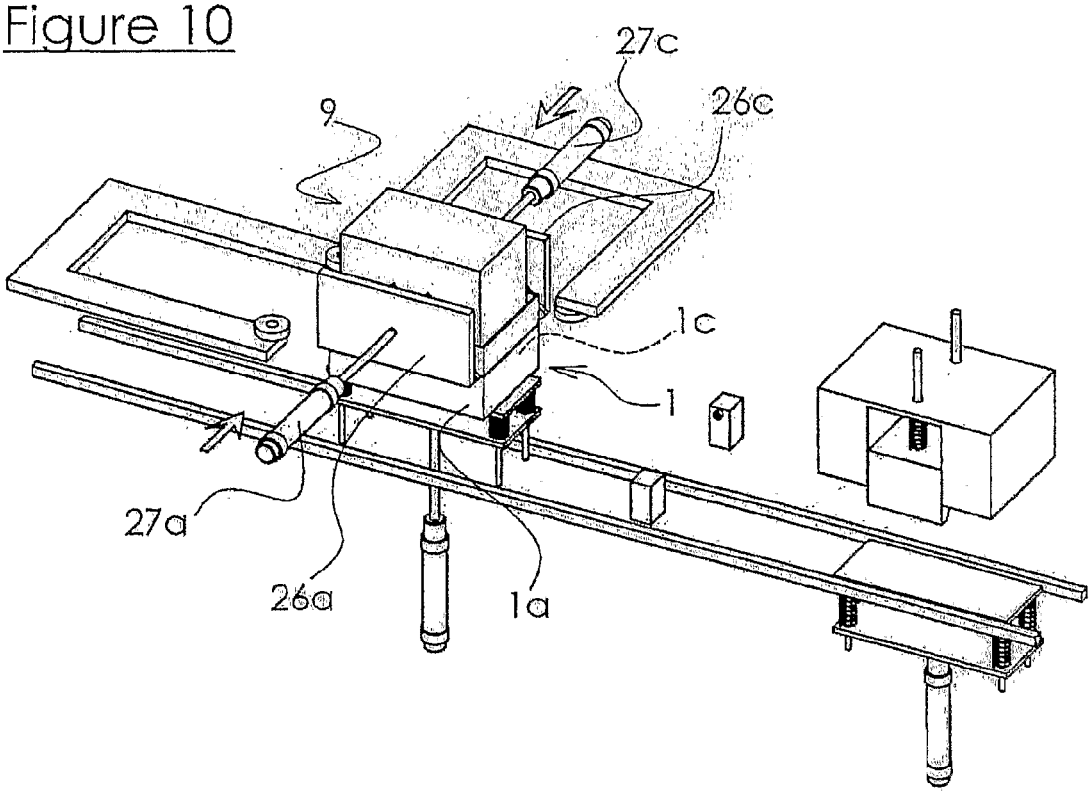

FIG. 10 shows the horizontal movement of plates 26*a* and 26*c* toward said mandrel 9, produced by actuators 27*a* and 27*c*. These horizontal movements result in oblique creases 8*aa*, 8*ab*, 8*ca* and 8*cb*, by crushing side walls 1*a* and 1*c* of said box 1 between tools 13*aa*, 13*ab*, 13*ca* and 13*cb* (not visible on FIG. 10) and anvils 12*aa*, 12*ab*, 12*ca* and 12*cb* (not visible on FIG. 10).

Figure 11:
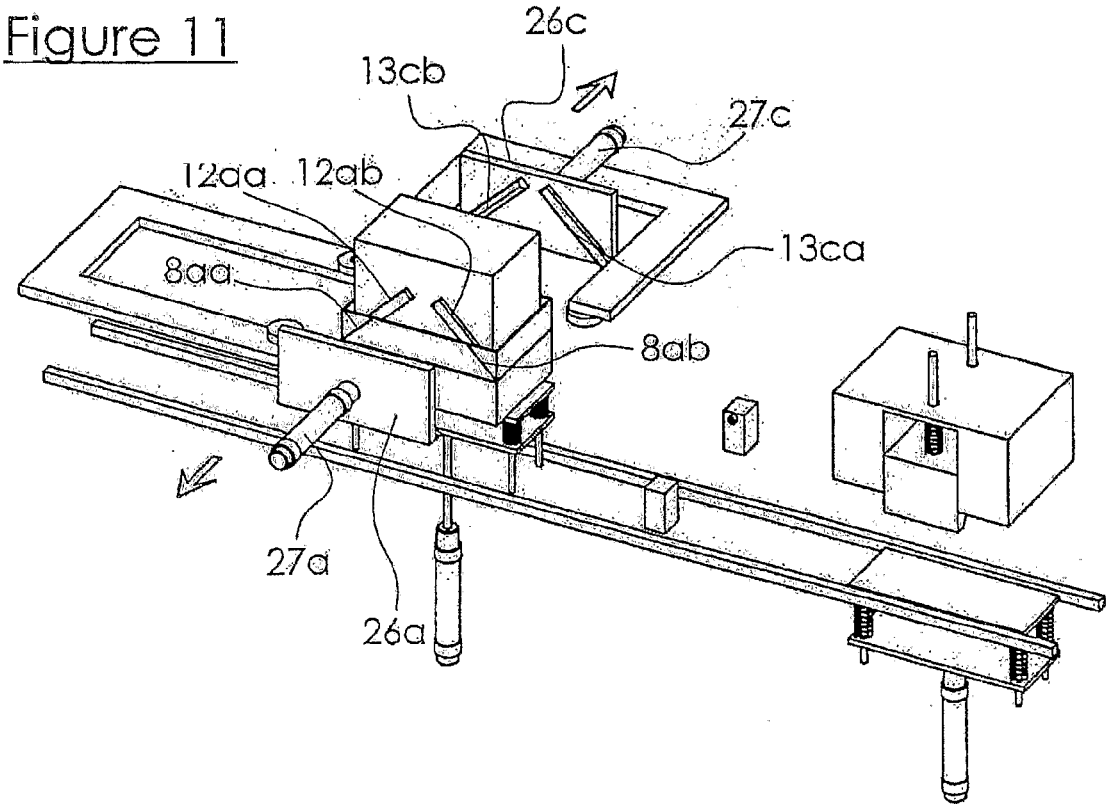

FIG. 11 shows plates 26*a* and 26*c* brought into resting position by actuators 27*a* and 27*c*. In this figure, the result of the actions illustrated by FIG. 10 and the parts of the machine put in operation are seen. For example, tools 13*ca* and 13*cb* and anvils 12*aa* and 12*ab* are shown. Also, oblique creases 8*aa* and 8*ab* are shown.

Figure 12:
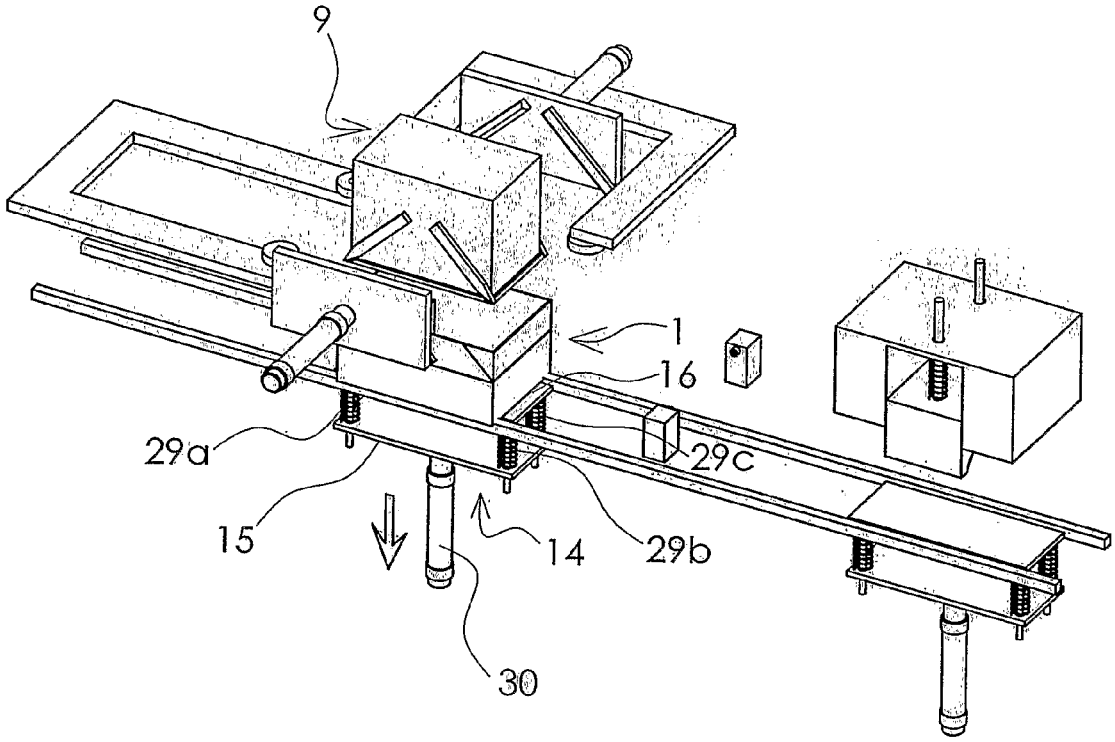

FIG. 12 shows box 1 coming out of mandrel 9 by return of elevator 14 in a low position, due to actuator 30. The upper plate 16 resumed its reference position in relation to said lower plate 15, actuated by springs 29*a*, 29*b* and 29*c*.

Figure 13:
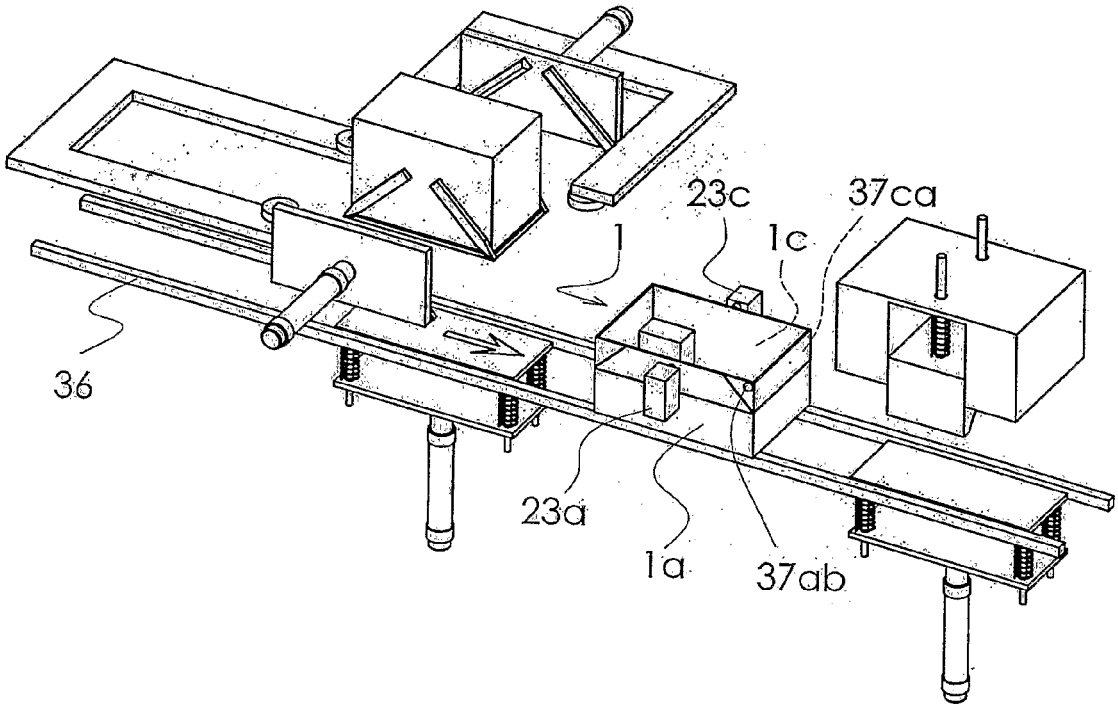
Figure 14:
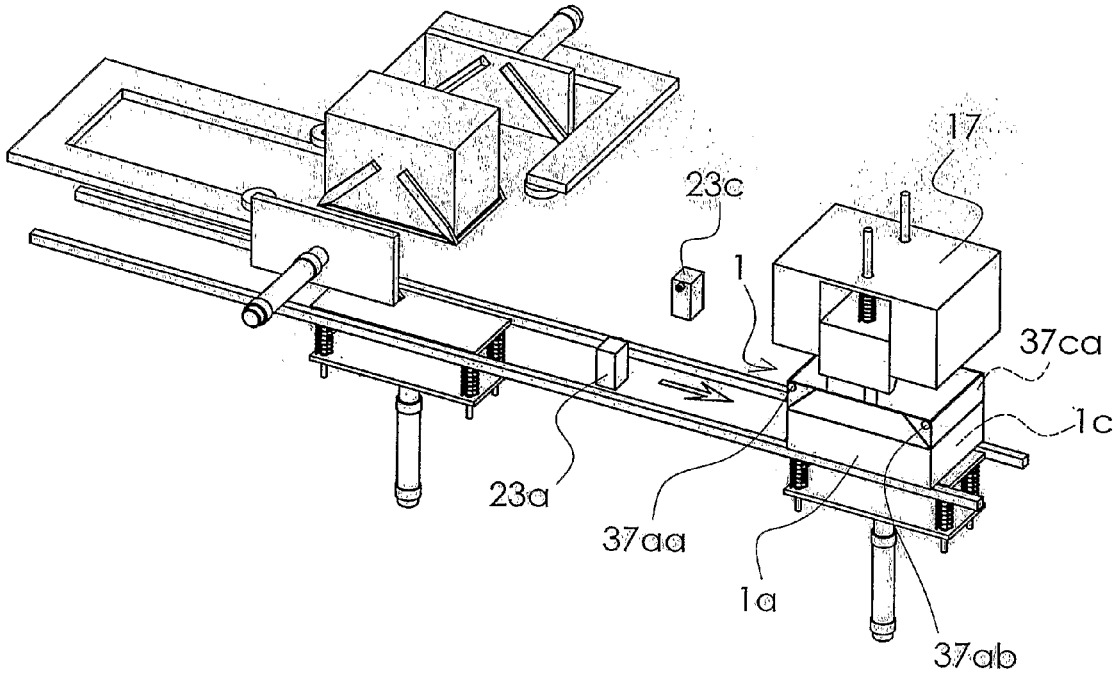

FIG. 13 shows said box 1 during its transfer toward the next work station, operated by conveyor system 36. In this figure, device 23*a* and 23*c* are positioned on the path of the boxes, between the creasing station and the folding station, to deposit drops or beads of glue on the upper portions of side walls 1*a* and 1*c* of box 1 upon the forward motion of said box. Glue drops 37*ab* and 37*ca* have just been deposited at the front end of said box. FIG. 14 shows said box 1 at the second work station, under said die 17. Glue drops 37*ab* and 37*ca* were deposited at the front end of said box. Glue drop 37*aa* is on wall 1*a*, and a fourth glue drop 37*cb* was also deposited on wall 1*c*, at the rear end of said box. Devices 23*a* and 23*c* are used to deposit these glue drops or beads.

Figure 15:
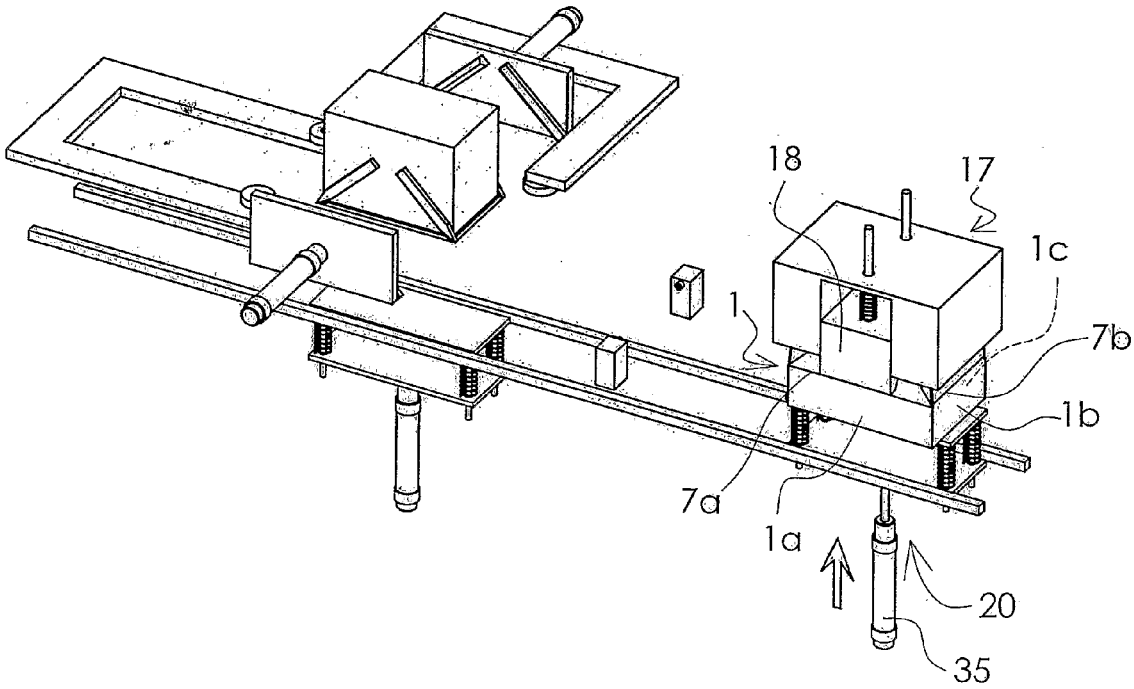
Figure 16:
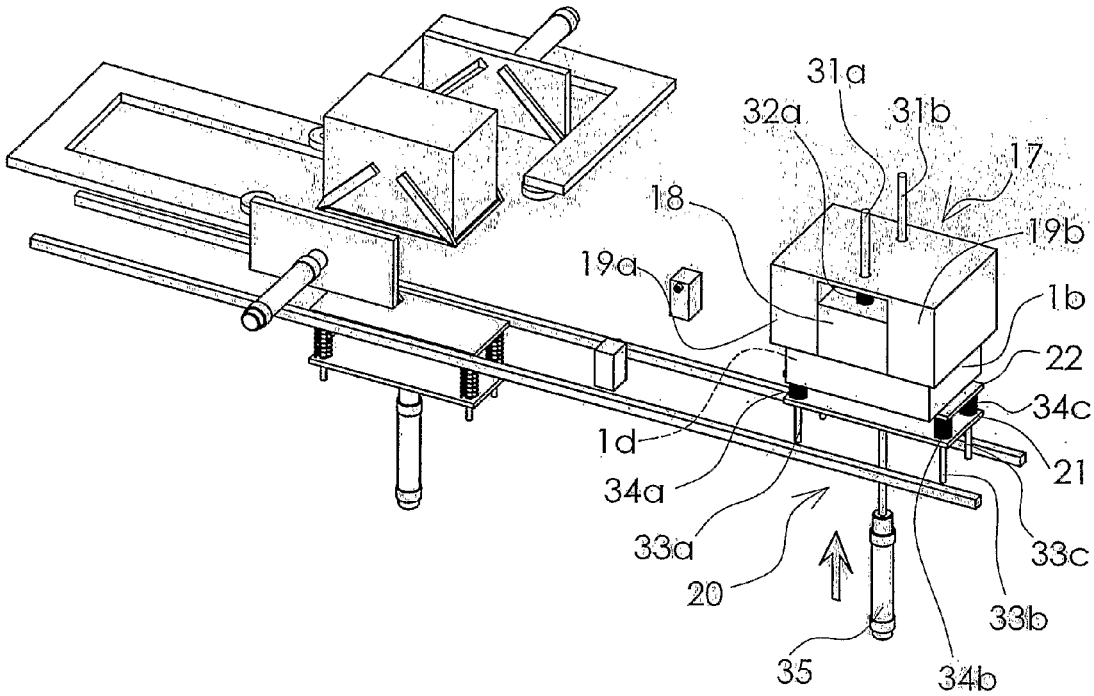

FIG. 15 shows box 1 in intermediate position after the start of the rise of second elevator 20 toward said die 17, produced by actuator 35. The upper ridge of wall 1*a* has come into contact with deflector 18, which resulted in the upper portion of said wall 1*a*, located on top of horizontal crease 7*a*, to be folded back toward the center of said box 1. The upper ridge of wall 1*c* has also come into contact with deflector 18, which has also resulted in the high portion of said wall 1*c*, located above horizontal crease 7*c*, to be folded back toward the center of said box 1. Folding of the upper portions of said walls a and 1*c* resulted in folding toward the center of said box 1 of the high portion of wall 1*b*, located above horizontal crease 7*b*. The same applies to the upper portion of wall 1*d*, located above horizontal crease 7*d*. FIG. 16 shows said box 1 in a high position upon completion of the rise of elevator 20 toward said die 17, produced by actuator 35.

It is obvious that, during the upward movement of said elevator 20, said horizontal creases 7*a* and 7*c* came into contact with deflector 18. The deflector 18 was then pulled upward by said box 1 to the end of the upward movement of said elevator 20. Guide columns 31*a* and 31*b* of said deflector 18 are in relation to said pressure devices 19*a* and 19*b*, and spring 32*a* was compressed by the relative movement of said deflector 18 in relation to said pressure devices 19*a* and 19*b*.

Upon completion of this upward movement, the upper ridge of wall 1*b* came into contact with the lower face of said pressure device 19*b*, and the upper ridge of wall 1*d* came into contact with the lower face of said pressure device 19*a*.

This movement resulted in completely folding down the upper portions of said walls 1*b* and 1*d*, until they meet in a horizontal plane, contacting the lower face of said pressure devices 19*a* and 19*b*. Folding of the upper portions of said walls 1*b* and 1*d* also resulted in the upper portions of said walls 1*a* and 1*c* to be folded toward the center of said box 1, until they also meet in a substantially horizontal plane, under the upper portions of said walls 1*b* and 1*d*.

Figure 17:
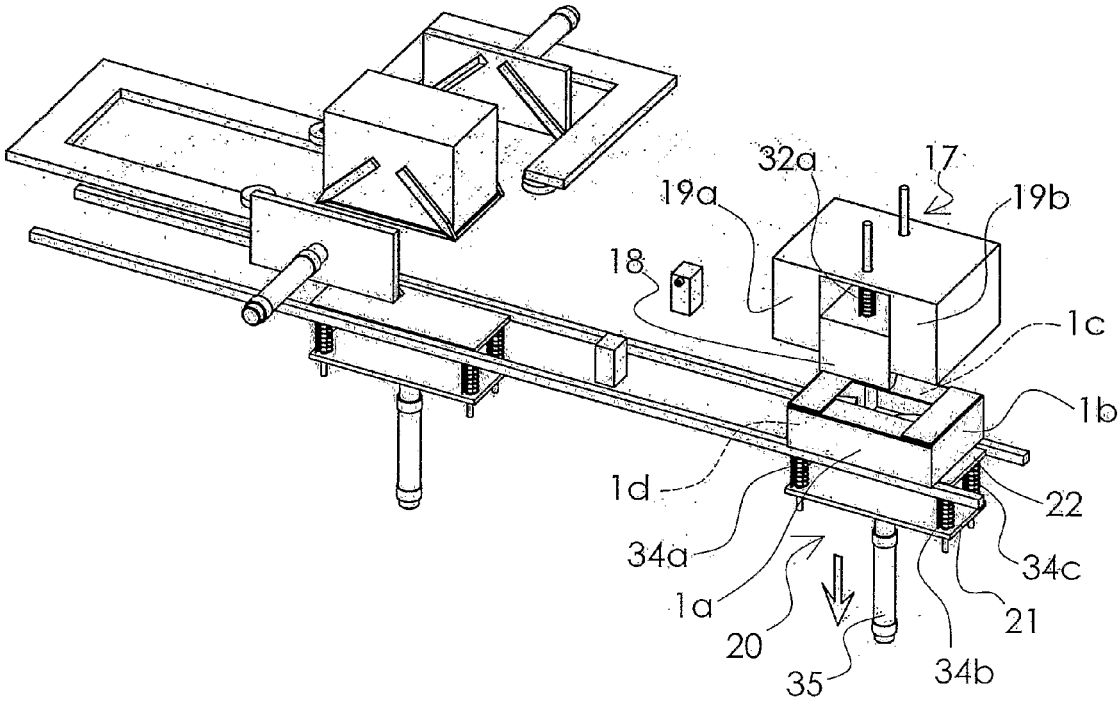

As the upper portions of said walls 1*b* and 1*d* came together in a horizontal plane, coming into contact with the lower faces of said pressure devices 19*a* and 19*b*, the vertical movement, of said box 1 and of the second plate or upper plate 22 which carries it, was stopped as the main plate or lower plate 21 proceeded with its upward movement. Guide columns 33*a*, 33*b* and 33*c* of said plate 22 are in relation to said plate 21, and springs 34*a*, 34*b* and 34*c* were compressed by the relative movement of said plates 21 and 22. FIG. 17 shows box 1 extracted from die 17 by return of elevator 20 in a low position, due to actuator 35. The upper plate 22 has resumed its reference position in relation to said lower plate 21, actuated by springs 34*a*, 34*b* and 34*c*. The deflector 18 has resumed its reference position in relation to said pressure devices 19*a* and 19*b*, actuated by spring 32*a*.

This figure shows that the upper portions of said side walls 1*a*, 1*b*, 1*c* and 1*d* of said box 1 were brought substantially into a horizontal plane.

Figure 18:
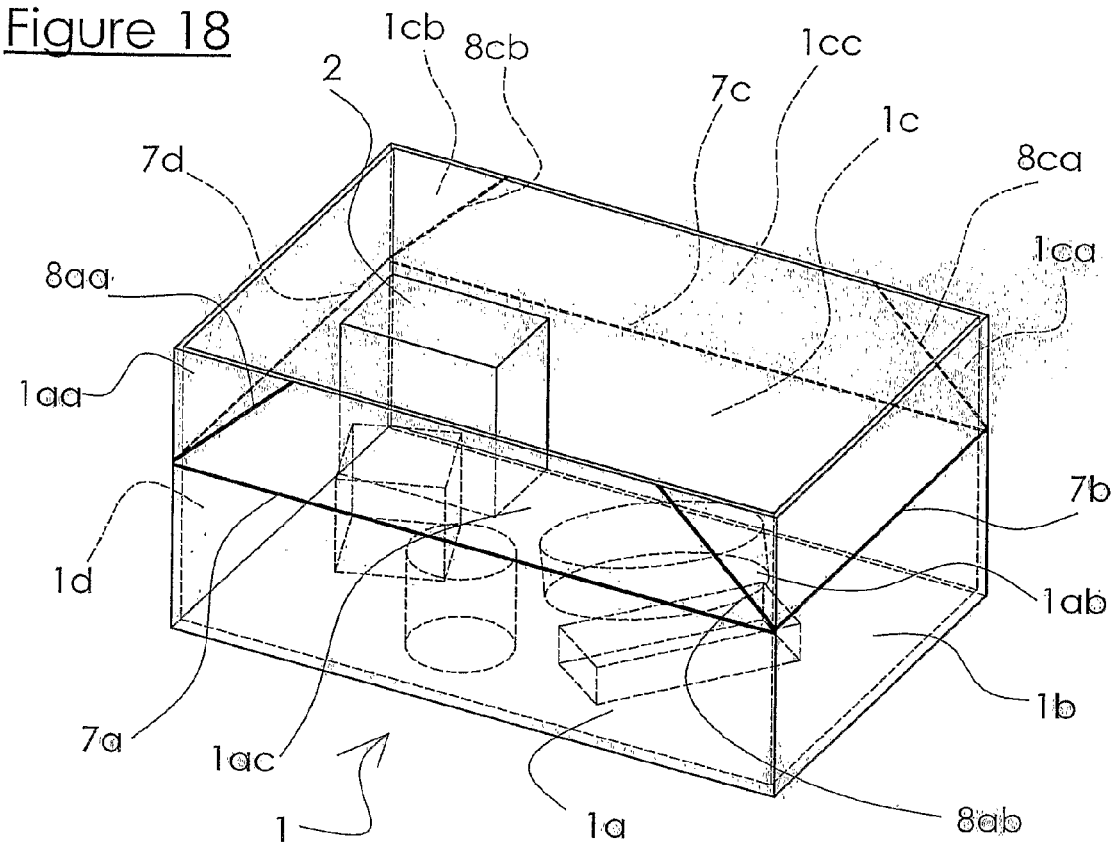
FIG. 18 is an isometric perspective view of the box upon completion of the initial stages of the operation cycle of the machine.

FIG. 18 shows said box 1 after having passed through its first machine station and having made horizontal creases 7*a*, 7*b*, 7*c* and 7*d* on each of walls 1*a*, 1*b*, 1*c* and 1*d*. Said horizontal creases 7*a*, 7*b*, 7*c* and 7*d* are made in a plane substantially located at the top of the stack of objects, in other words, at the upper face of object 2.

Oblique creases 8*aa* and 8*ab* are made on wall 1*a*, and oblique creases 8*ca* and 8*cb* are made on wall 1*c*.

Figure 19:
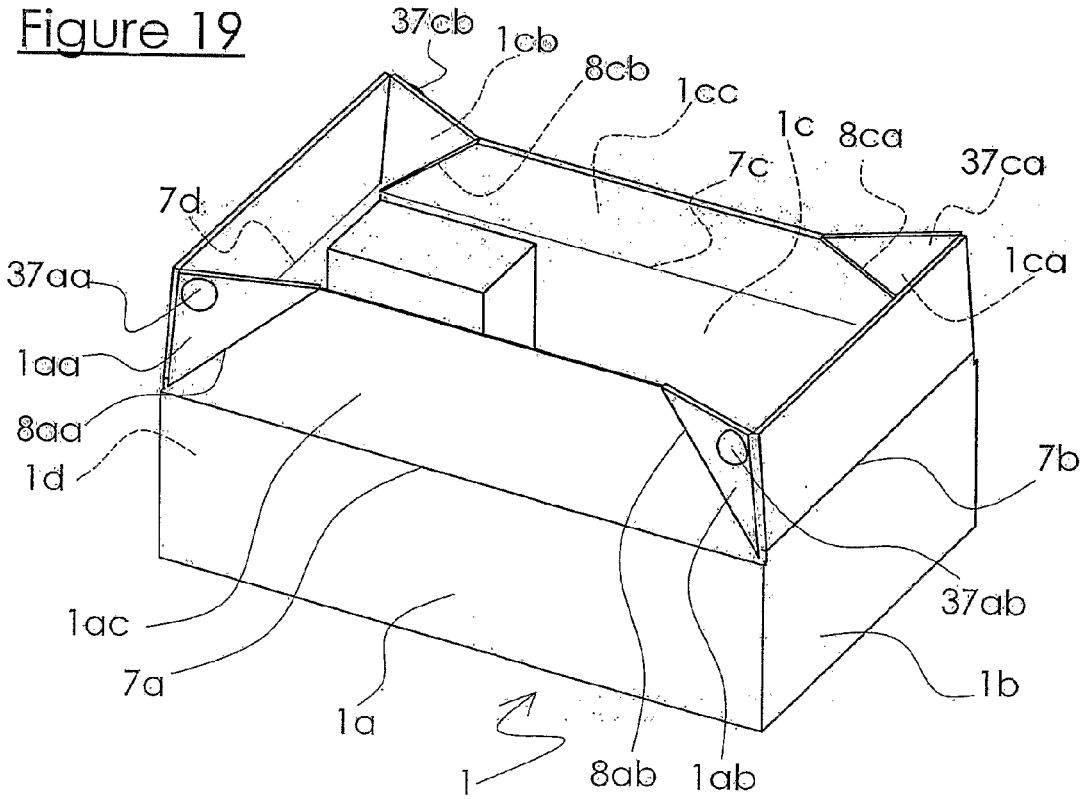
FIG. 19 is an isometric perspective view of the box after running the other operation cycle of the machine.

Said creases 7*a*, 8*aa* and 8*ab* have created three flaps 1*aa*, 1*ab* and 1*ac* on the upper portion of said wall 1*a*, and said creases 7*c*, 8*ca* and 8*cb* have also created three flaps 1*ca*, 1*cb* and 1*cc* on the upper portion of said wall 1*c*. The upper portion of wall 1*c* is thus comprised of one trapezoidal center flap 1*ac* and two triangular flaps 1*aa* and 1*ab* that are connected to the center flap by folding lines, respectively 8*aa* and 8*ab*, while the high portion of wall 1*c* consists of one trapezoidal center flap 1*cc* and two triangular flaps 1*ca* and 1*cb* that are connected to the center flap by folding lines, respectively 8*ca* and 8*cb*. FIG. 19 shows said box 1 at a later stage of the operating cycle of the machine. This figure shows the glue points that were placed on some of said flaps. Glue point 37*aa* is on said flap 1*aa*, and glue point 37*ab* is on said flap lab. Glue point 37*ca* is on said flap 1*ca*, and glue point 37*cb* is on said flap 1*cb*.

FIG. 19 shows the upper portions of said walls 1*a*, 1*b*, 1*c* and 1*d* as they fold toward the center of said box 1 by pivoting around said horizontal creases. The upper portion of said wall pivots around said horizontal crease 7*a*. The upper portion of said wall 1*b* pivots around said horizontal crease 7*b*. The upper portion of said wall 1*c* pivots around said horizontal crease 7*c*, and the upper portion of said wall 1*d* pivots around said horizontal crease 7*d*. Upon completion of movement, the pivoting angle of the upper portions of said side walls around said horizontal creases will be about 90° as said upper portions will have been brought into a substantially horizontal plane.

In this figure, the different flaps separated by said oblique creases are also simultaneously folded over one another by pivoting around said oblique creases. Said flap 1*aa* is folded on said flap 1*ac* by pivoting around said crease 8*aa*, said flap 1*ab* is folded on said flap 1*ac* by pivoting around said crease 8*ab*, said flap 1*ca* is folded over said flap 1*cc* by pivoting around said crease 8*ca*, and said flap 1*cb* is folded over said flap 1*cc* by pivoting around said crease 8*cb*. Upon completion of the movement, the pivoting angle of said flaps between them will be about 180° as said flaps will have been brought into a substantially horizontal plane.

Figure 20:
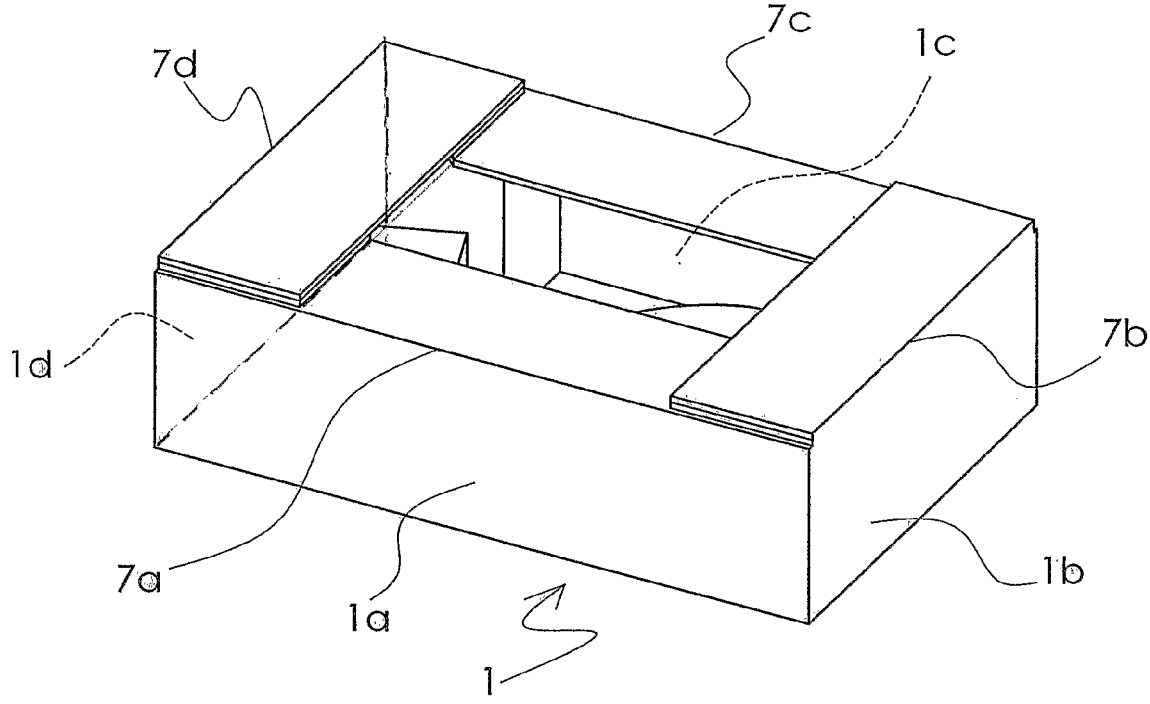
FIG. 20 is an isometric perspective view of the box upon completion of the operation cycle of the machine.

Glue points 37*aa*, 37*ab*, . . . , situated on the surface of at least one of the flaps 1*aa*, 1*ab*, intended to come into contact with the surface of another flap 1*ac*, 1*cc*, . . . , are applied before the folding of the upper portion of walls 1*a*, 1*b*, 1*c*, 1*d* of the box, thus ensuring that said upper portion is kept folded back in horizontal position FIG. 20 shows said box 1 as it comes out of the machine, after complete fold-back of the upper portions of side walls 1*a*, 1*b*, 1*c* and 1*d* so that said upper portions meet in a horizontal plane located at said horizontal creases 7*a*, 7*b*, 7*c* and 7*d*, substantially at the top of the stack of objects previously placed in said box 1.

In order not to extend and complicate unnecessarily the description and the drawings, programmable automation devices, motorization and transmission devices that ensure the operation of the different work stations of the machine are now described. These controllers, motorization and transmission devices are not within the scope of the invention, and they are well known to the experts in the field.

We claim:

1. Process for adjusting height of a box or crate made of a pliable material, each box being comprised of a base and at least four side walls, the side walls having upper portions folded on top of a stack of objects previously placed in said box, said process for adjusting height comprising the steps of:

placing said base of said box in a generally horizontal or substantially horizontal plane;

making a horizontal crease or scoring on each side wall, parallel to said base, at a height substantially same as said top of said stack of objects;

making at least one oblique crease or scoring in each angle of said box, one end being located at an intersection between said horizontal crease, another end being located at an upper ridge of one side wall, the oblique crease forming an angle of substantially 45° with said horizontal crease made in said one side wall; and folding said upper portions back toward a center of said box, around said horizontal crease, at an angle of substantially 90°, and simultaneously, one on top of another, different flaps being folded back, separated by the oblique crease and being comprised of said upper portions of said side walls, around oblique creases and at an angle substantially of 180°, said upper portion being in a substantially horizontal plane.

2. Process according to claim 1, wherein the step of making horizontal creases comprises:

installing a mandrel inside said box, said mandrel having a horizontal sharp-edged ridge positioned against an internal face of a side wall at a crease line to be made and being actuated by a roller applied and pressed against an external face of said side wall and moved along the ridge, crushing said side wall against the ridge.

3. Method according to any claim 1, wherein said step of making oblique creases comprises:

installing a mandrel inside said box, said mandrel having an anvil positioned against the internal face of the side wall at the crease line to be made and being operated a tool with a sharp-edged ridge, said mandrel being applied and pressed against the external face of the side wall, said tool performing the oblique crease by crushing said side wall against said anvil.

4. Method according to claim 2 said mandrel being fixed, height of rollers and tools being fixed, wherein vertical positioning of said box in relation to said mandrel, rollers and tools is obtained by placement of said box around said mandrel, the horizontal creases being at a height substantially same as the top of said stack of objects, said vertical positioning being generated by upward vertical movement of an elevator supporting said box.

5. Method according to claim 1, wherein the steps of making creases comprises:

exerting a horizontal stress initially on the upper portions of said side walls containing oblique creases, to ensure partial folding toward said center of said box, said folding resulting simultaneously in partial folding of the upper portions of side walls without oblique creases, said side walls without oblique creases being adjacent; and directing a vertical stress downward on the upper portions of said side walls until all said upper portions of said side walls are completely folded back, said side walls being in a horizontal plane substantially level with the top of the stack of objects.

6. Method according to claim 1, further comprising:

depositing a drop or layer of glue on an external surface of at least one of the flaps intended to come into contact with an external surface of another flap, before the upper portions of the said walls are folded back, said upper portion remaining folded back in a horizontal position.

7. Machine for adjusting height of a box, said box being comprised of a base and at least four side walls, the side walls having upper portions folded back on top of a stack of objects previously placed in said box, said machine comprising:

means to make a horizontal crease or scoring on each of said side walls, parallel to the said base, at a height substantially same as said top of said stack of objects;

means to make at least one oblique crease or scoring on each angle of said box, the oblique crease having one end at an intersection between both horizontal creases and another end located at an upper ridge of one side wall oblique crease forming an angle of substantially 45° with a horizontal plane; and means to fold an upper portion of each side wall toward a center of said box, around said horizontal crease and means to fold simultaneously various flaps on top of one another, the flaps being comprised of the upper portion of side walls, around said oblique creases, said upper portion of said side walls being in a substantially horizontal plane.

8. Machine according to claim 7, further comprising:

a fixed mandrel; and an elevator located below said mandrel, said box being placed around said mandrel.

9. Machine according to claim 8, wherein said means for making said horizontal creases, comprises one sharp-edged horizontal ridge mounted on a lower portion of said mandrel, and a moving roller, being moveable along the ridge, crushing a side wall against the ridge; and wherein said means for making said oblique creases comprises an anvil mounted on a side of said mandrel, and one tool with a sharp-edged ridge, being moveable toward said anvil, crushing the side wall against said anvil.

10. Machine according to claim 9, wherein said means for making horizontal creases comprises pressure rollers mounted near free ends of open moving frames moveable in orthogonal directions, said pressure rollers being positioned in a same horizontal plane, said pressure rollers being placed on an upper face of parallel branches of one of the open frames, whereas other pressure rollers are placed under a lower face of parallel branches of a second open frame.

11. Machine according to claim 8, wherein said elevator is comprised of a lower plate and an upper plate, supporting said box, said upper plate being mobile in relation to said lower plate, upward vertical movement of said elevator immobilizing said box and said upper plate when the top of said stack of objects contacts a lower face of said mandrel, movement of said lower plate being able to proceed with a predetermined amplitude independent of how much said box has been filled, due to relative movement of said upper plate in relation to said lower plate.

12. Machine according to claim 8, further comprising:

a die; and a second elevator, placing said box in said die by upward vertical movement the upper portions of side walls being folded by bringing the upper portions into a horizontal plane located substantially at the top of the stack of objects.

13. Machine according to claim 12, wherein said die is comprised of at least one deflector device exerting a horizontal stress, at the beginning of insertion movement of said box in said die, on the upper portions of said side walls with oblique creases, the upper portions being partial folded toward a center of said box, wherein said die is further comprised of at least one pressure device exerting a vertical stress, at an end of the insertion movement of said box in said die, on the upper portions of said side walls without an oblique crease, said upper portions of said side walls being completely folded into the horizontal plane located substantially at the top of the stack of objects.

14. Machine according to claim 12, wherein said second elevator is comprised of a lower plate and upper plate, supporting said box said upper plate being mobile in relation to said lower plate, vertical upward movement of said elevator causing said box and said upper plate to be motionless while complete folding of said upper portions of all said side walls, movement of said lower plate continuing with a predetermined amplitude, independent of how high said box is filled, due to relative movement of said secondary plate in relation to said base plate.

15. Machine according to claim 14, further comprising return springs mounted between the lower and upper plates of elevators, said return springs being comprised of helical springs arranged around guide columns unitized with the upper plates and passing through guide holes made in the lower plates.

16. Machine according to claim 7, further comprising:

means to deposit glue, positioned between a creasing station and folding stations of the upper portions of side walls, on an external face of certain flaps of the upper portions of said side walls (1*a* and 1*c*) connected by oblique creases, said glue interbonding of said flaps after folding of said flaps on top of one another, the upper portion of all said side walls being maintained in a substantially horizontal plane after being folded back completely.

* * * * *